US007820005B2

(12) United States Patent
Jensen et al.

(10) Patent No.: US 7,820,005 B2
(45) Date of Patent: Oct. 26, 2010

(54) MULTILAYER CHEMICAL MECHANICAL POLISHING PAD MANUFACTURING PROCESS

(75) Inventors: Michelle Jensen, Newark, DE (US); John Gifford Nowland, Elkton, MD (US); Brenda Harding, Newark, DE (US); Carol Corder, Elk Mills, MD (US)

(73) Assignee: Rohm and Haas Electronic Materials CMP Holdings, Inc., Newark, DE (US)

( * ) Notice: Subject to any disclaimer, the term of this patent is extended or adjusted under 35 U.S.C. 154(b) by 210 days.

(21) Appl. No.: 12/175,992

(22) Filed: Jul. 18, 2008

(65) Prior Publication Data

US 2010/0012269 A1 Jan. 21, 2010

(51) Int. Cl.
*B32B 7/14* (2006.01)
*B32B 37/10* (2006.01)

(52) U.S. Cl. ..... 156/295; 156/289; 156/299; 156/291; 51/297; 451/533; 451/538; 451/539

(58) Field of Classification Search ..... 156/299, 156/289, 295; 541/538, 533; 51/297
See application file for complete search history.

(56) References Cited

U.S. PATENT DOCUMENTS 4,728,552 A 3/1988 Jensen, Jr.
5,222,331 A * 6/1993 Manor et al. ..... 451/524
5,257,478 A 11/1993 Hyde et al.
5,507,906 A * 4/1996 Woods et al. ..... 156/271
6,616,519 B2 * 9/2003 Mansfield ..... 451/512
6,699,104 B1 3/2004 Baker, III et al.
6,884,156 B2 4/2005 Prasad et al.
7,101,275 B2 9/2006 Roberts et al.
7,377,018 B2 * 5/2008 Taylor ..... 29/402.01

OTHER PUBLICATIONS

Copending U.S. Appl. No. 12/175,965, published Jan. 21, 2010.

* cited by examiner

*Primary Examiner*—Khanh Nguyen
*Assistant Examiner*—Margaret Squalls
(74) *Attorney, Agent, or Firm*—Thomas S. Deibert

(57) ABSTRACT

A method for making a multilayer chemical mechanical polishing pad comprising: providing a polishing layer, providing a subpad layer, optionally providing additional layers, providing an unset reactive hot melt adhesive, applying the unset reactive hot melt adhesive in a pattern on a surface of at least one of the layers, applying one of the other layers over the pattern of unset reactive hot melt adhesive, pressing the two layers together with the unset reactive hot melt adhesive interposed therebetween, allowing the unset reactive hot melt adhesive to set forming a reactive hot melt adhesive bond between the two layers.

9 Claims, 10 Drawing Sheets

MULTILAYER CHEMICAL MECHANICAL POLISHING PAD MANUFACTURING PROCESS

The present invention relates generally to the field of chemical mechanical polishing. In particular, the present invention is directed to a multilayer chemical mechanical polishing pad manufacturing process useful in the manufacture of chemical mechanical polishing pads.

In the fabrication of integrated circuits and other electronic devices, multiple layers of conducting; semiconducting and dielectric materials are deposited onto and removed from a surface of a semiconductor wafer. Thin layers of conducting, semiconducting and dielectric materials may be deposited using a number of deposition techniques. Common deposition techniques in modern wafer processing include physical vapor deposition (PVD), also known as sputtering, chemical vapor deposition (CVD), plasma-enhanced chemical vapor deposition (PECVD) and electrochemical plating, among others. Common removal techniques include wet and dry isotropic and anisotropic etching, among others.

As layers of materials are sequentially deposited and removed, the uppermost surface of the wafer becomes non-planar. Because subsequent semiconductor processing (e.g., metallization) requires the wafer to have a flat surface, the wafer needs to be planarized. Planarization is useful for removing undesired surface topography and surface defects, such as rough surfaces, agglomerated materials, crystal lattice damage, scratches and contaminated layers or materials.

Chemical mechanical planarization, or chemical mechanical polishing (CMP), is a common technique used to planarize or polish workpieces such as semiconductor wafers. In conventional CMP, a wafer carrier, or polishing head, is mounted on a carrier assembly. The polishing head holds the wafer and positions the wafer in contact with a polishing layer of a polishing pad that is mounted on a table or platen within a CMP apparatus. The carrier assembly provides a controllable pressure between the wafer and polishing pad. Simultaneously, a polishing medium is dispensed onto the polishing pad and is drawn into the gap between the wafer and polishing layer. To effect polishing, the polishing pad and wafer typically rotate relative to one another. As the polishing pad rotates beneath the wafer, the wafer sweeps out a typically annular shaped polishing track, or polishing region, wherein the wafer's surface directly confronts the polishing layer. The wafer surface is polished and made planar by chemical and mechanical action of the polishing layer and polishing medium on the surface.

Rutherford et al., in U.S. Pat. No. 6,007,407, disclose multilayer chemical mechanical polishing pads, wherein two layers of different materials are laminated together. The typical two-layer polishing pad includes an upper polishing layer formed of a material, such as, polyurethane suitable for polishing the surface of a substrate. The upper polishing layer is attached to a lower layer or "subpad" formed from a material suitable for supporting the polishing layer. Conventionally, the two layers are bonded together using a pressure sensitive adhesive. In some polishing applications, however, multilayer chemical mechanical polishing pads laminated together using pressure sensitive adhesives have a tendency to delaminate during polishing, rendering the polishing pad useless and impeding the polishing process.

One approach to alleviating the delamination problem is disclosed in U.S. Pat. No. 7,101,275 to Roberts et al. Roberts et al. disclose resilient laminated polishing pads for chemical mechanical polishing, which pads include a base layer bonded to a polishing layer by a reactive hot melt adhesive rather than a pressure sensitive adhesive.

Notwithstanding, there is a continuing need for resilient multilayer laminated chemical mechanical polishing pads that resist internal breakdown (i.e., delamination) during use and methods of making the same.

In one aspect of the present invention, there is provided a method for manufacturing a multilayer chemical mechanical polishing pad comprising: providing a polishing layer; providing a subpad layer; providing an unset reactive hot melt adhesive; applying the unset reactive hot melt adhesive to the subpad layer, wherein the unset reactive hot melt adhesive is applied in a pattern of parallel lines; placing the polishing layer over the pattern of parallel lines of unset reactive hot melt adhesive forming a polishing pad stack; applying a force to the polishing pad stack pressing the polishing layer and subpad layer together; and, allowing the unset reactive hot melt adhesive to set forming a reactive hot melt adhesive bond between the polishing layer and the subpad layer forming a multilayer chemical mechanical polishing pad.

In another aspect of the present invention, there is provided a method for manufacturing a multilayer chemical mechanical polishing pad comprising: providing a polishing layer; providing a subpad layer having a top surface, a bottom surface and at least two wrap around tabs; providing a backing plate having a top side and a bottom side; providing an unset reactive hot melt adhesive; placing the subpad layer onto the backing plate with the bottom surface of the subpad layer facing the top side of the backing plate; folding the at least two wrap around tabs around to the bottom side of the backing plate and securing the at least two wrap around tabs to the bottom side of the backing plate; applying the unset reactive hot melt adhesive to the top surface of the subpad layer, wherein the unset reactive hot melt adhesive is applied in a pattern of parallel lines; placing the polishing layer over the pattern of parallel lines of unset reactive hot melt adhesive forming a polishing pad stack; applying a force to the polishing pad stack pressing the polishing layer and subpad layer together; allowing the unset reactive hot melt adhesive to set forming a reactive hot melt adhesive bond between the polishing layer and the subpad layer; and, removing the at least two wrap around tabs from the subpad layer and separating the subpad layer from the backing plate.

In another aspect of the present invention, there is provided a method for manufacturing a multilayer chemical mechanical polishing pad comprising: providing a polishing layer; providing a subpad layer having a top surface, a bottom surface and at least two wrap around tabs; providing an intervening layer having a top face and a bottom face; providing a backing plate having a top side and a bottom side; providing a first unset reactive hot melt adhesive; providing a second unset reactive hot melt adhesive; placing the subpad layer onto the backing plate with the bottom surface of the subpad layer facing the top side of the backing plate; folding the at least two wrap around tabs around to the bottom side of the backing plate and securing the at least two wrap around tabs to the bottom side of the backing plate; applying the first unset reactive hot melt adhesive to the top surface of the subpad layer, wherein the first unset reactive hot melt adhesive is applied in a first pattern of parallel lines; placing the intervening layer over the first pattern of parallel lines with the bottom face facing the first pattern of parallel lines; applying the second unset reactive hot melt adhesive to the top face of the intervening layer, wherein the second unset reactive hot melt adhesive is applied in a second pattern of parallel lines; placing the polishing layer over the second pattern of parallel lines forming a polishing pad stack; applying a force to the polishing pad stack pressing the polishing layer and subpad layer toward one another; allowing the first unset reactive hot melt adhesive and the second unset reactive hot melt adhesive to set forming a first reactive hot melt adhesive bond between the subpad layer and the intervening layer and a second reactive hot melt adhesive bond between the intervening layer and the polishing layer; and, removing the at least two wrap around tabs from the subpad layer and separating the subpad layer from the backing plate.

In another aspect of the present invention, there is provided a method for manufacturing a multilayer chemical mechanical polishing pad comprising: providing a polishing layer; providing a subpad layer having a top surface, a bottom surface and at least two perforated wrap around tabs; providing a backing plate having a top side and a bottom side; providing a sacrificial layer having at least two recessed areas designed to facilitate attachment of the subpad layer to the backing plate; providing an unset reactive hot melt adhesive; providing a first pressure sensitive adhesive; providing a second pressure sensitive adhesive; providing a release liner; applying the first pressure sensitive adhesive to the bottom surface of the subpad layer; placing the release liner over the first pressure sensitive adhesive, wherein the first pressure sensitive adhesive is disposed between the release liner and the bottom surface of the subpad layer; applying the second pressure sensitive adhesive to the sacrificial layer; placing the sacrificial layer on the bottom side of the backing plate with the second pressure sensitive adhesive interposed between the sacrificial layer and the bottom side of the backing plate, wherein the second pressure sensitive adhesive secures the sacrificial layer to the bottom side of the backing plate; removing the release liner from the at least two wrap around tabs exposing the first pressure sensitive adhesive applied thereto; placing the subpad layer onto the backing plate with the bottom surface of the subpad layer facing the top side of the backing plate; folding the at least two wrap around tabs around to the bottom side of the backing plate and securing the at least two wrap around tabs to the bottom side of the backing plate using the first pressure sensitive adhesive; applying the unset reactive hot melt adhesive to the top surface of the subpad layer, wherein the unset reactive hot melt adhesive is applied in a pattern of parallel lines; placing the polishing layer over the pattern of parallel lines of the unset reactive hot melt adhesive forming a polishing pad stack; applying a force to the polishing pad stack pressing the polishing layer and subpad layer together; allowing the unset reactive hot melt adhesive to set forming a reactive hot melt adhesive bond between the polishing layer and the subpad layer; and, removing the at least two wrap around tabs from the subpad layer and separating the subpad layer from the backing plate.

DETAILED DESCRIPTION

Figure 1:
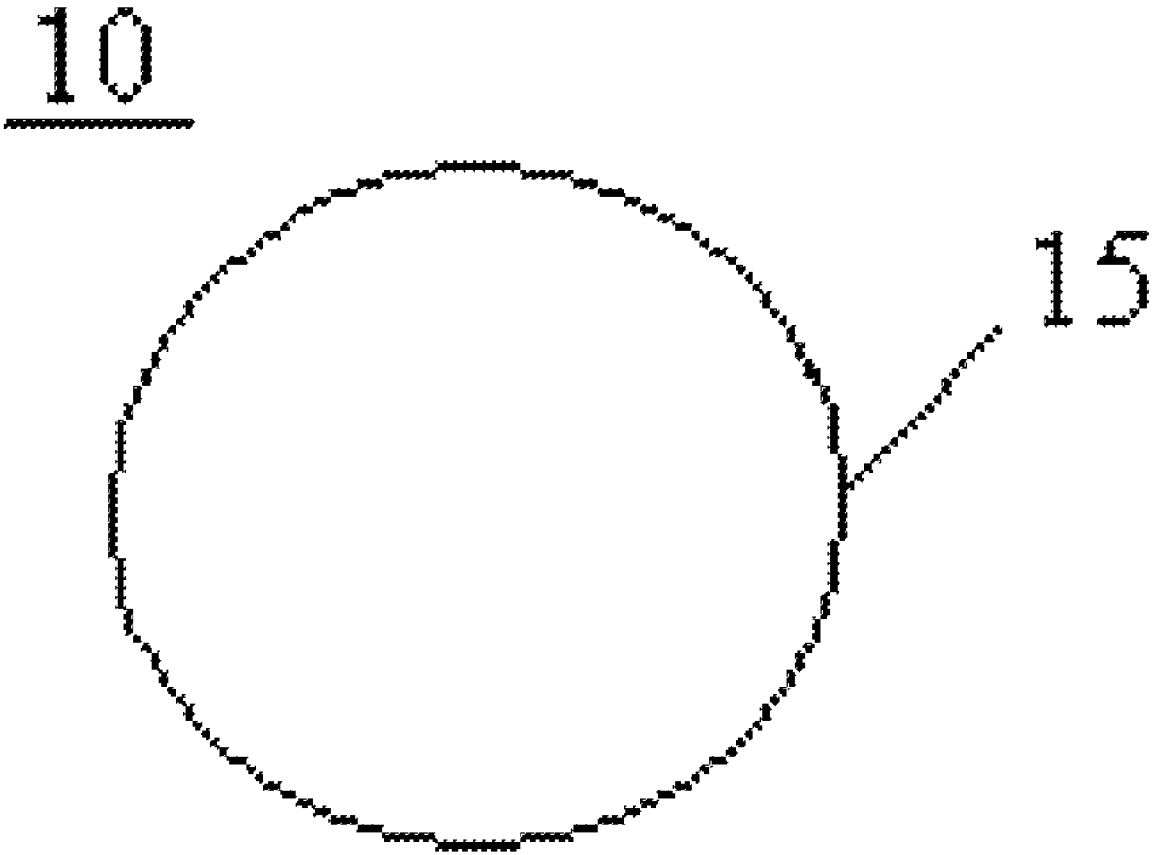
FIG. 1 is a depiction of a top plan view of a backing plate for use with a method of the present invention.
Figure 2:
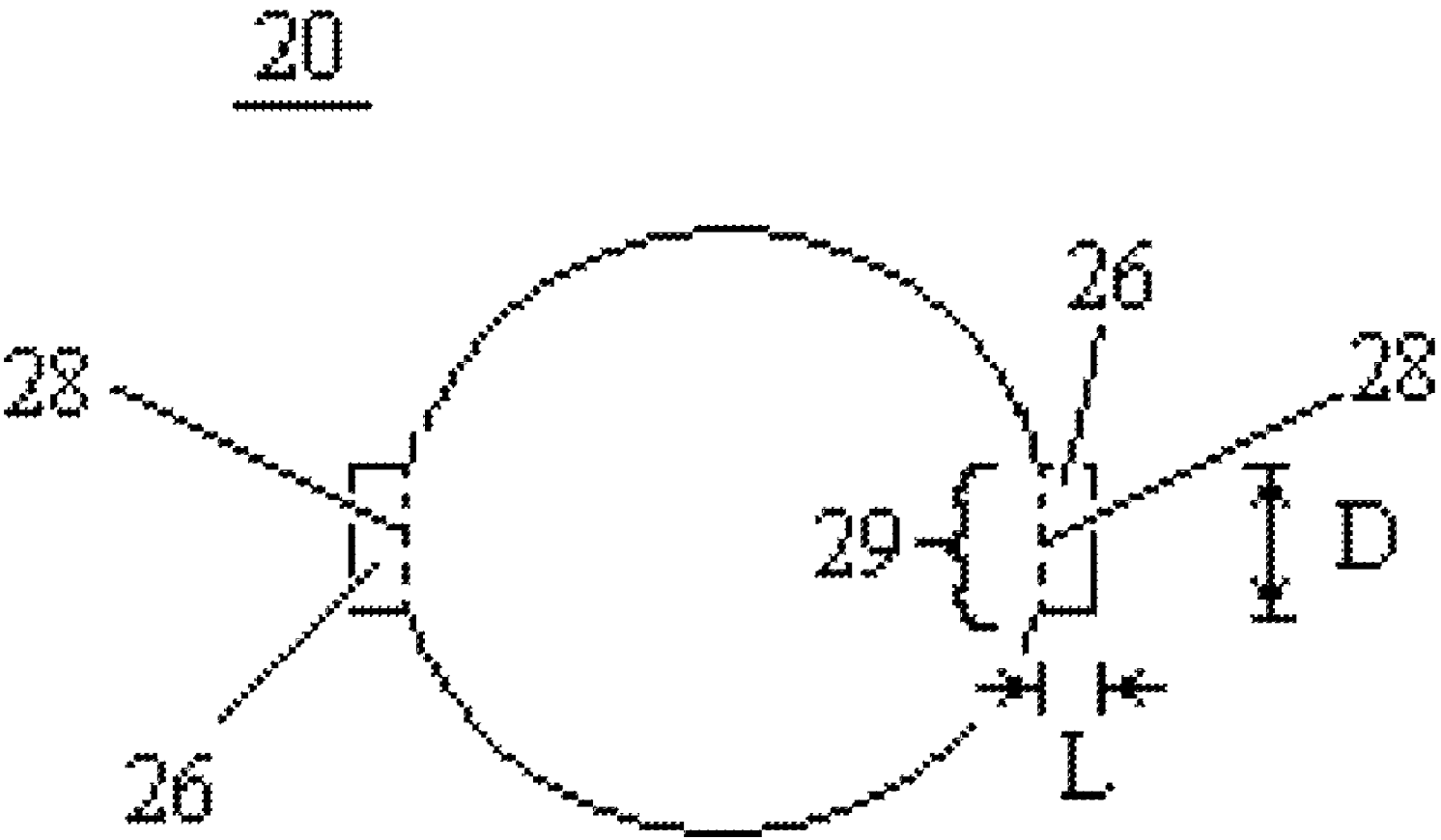
FIG. 2 is a depiction of a top plan view of a subpad layer for use with a method of the present invention.
Figure 3:
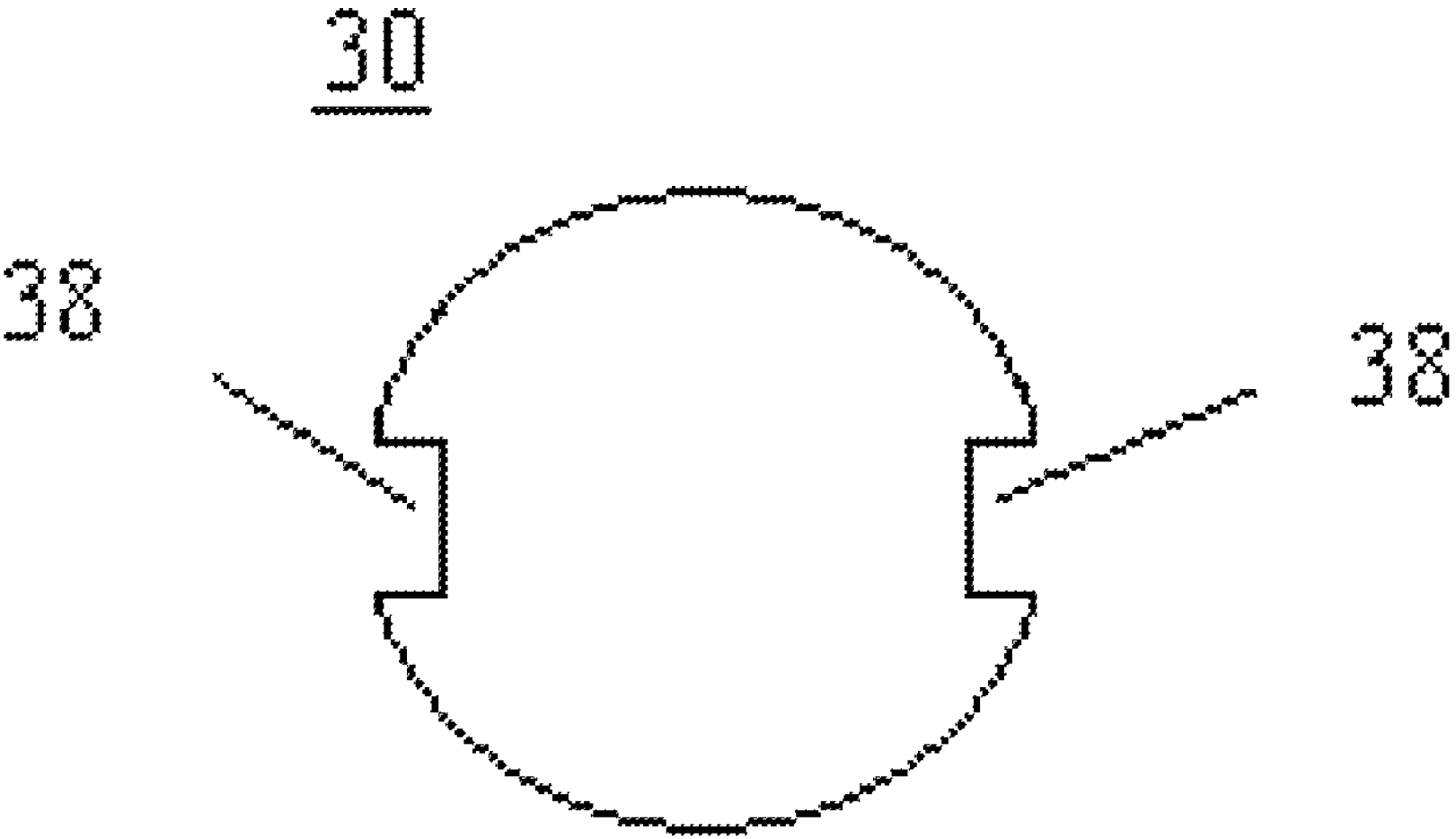
FIG. 3 is a depiction of a top plan view of a sacrificial layer for use with a method of the present invention.
Figure 4A:
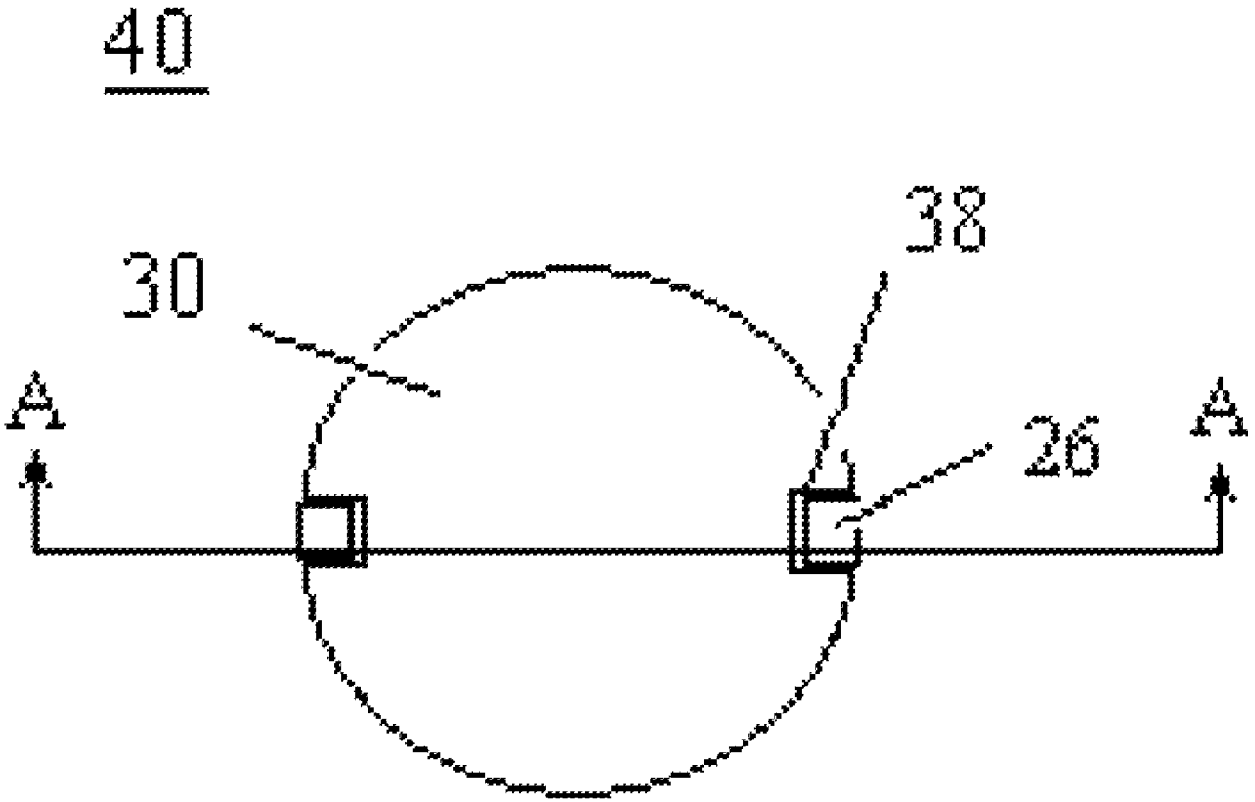
FIG. 4A is a depiction of a bottom plan view of a chemical mechanical polishing pad manufacturing assembly for use with a method of the present invention.
Figure 4B:
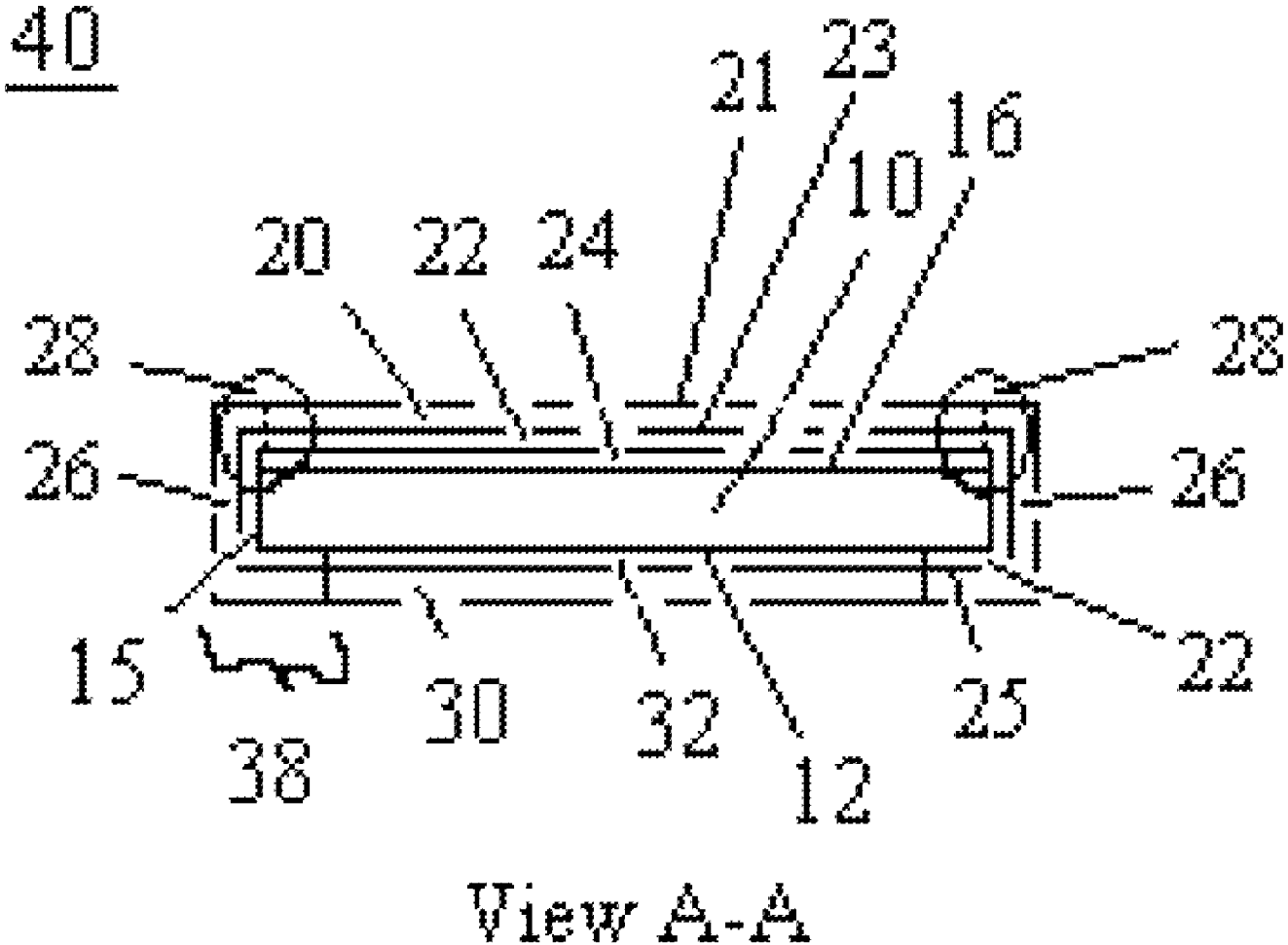
FIG. 4B is a depiction of an elevation cut away view A-A of the chemical mechanical polishing pad manufacturing assembly of FIG. 4A.
Figure 5:
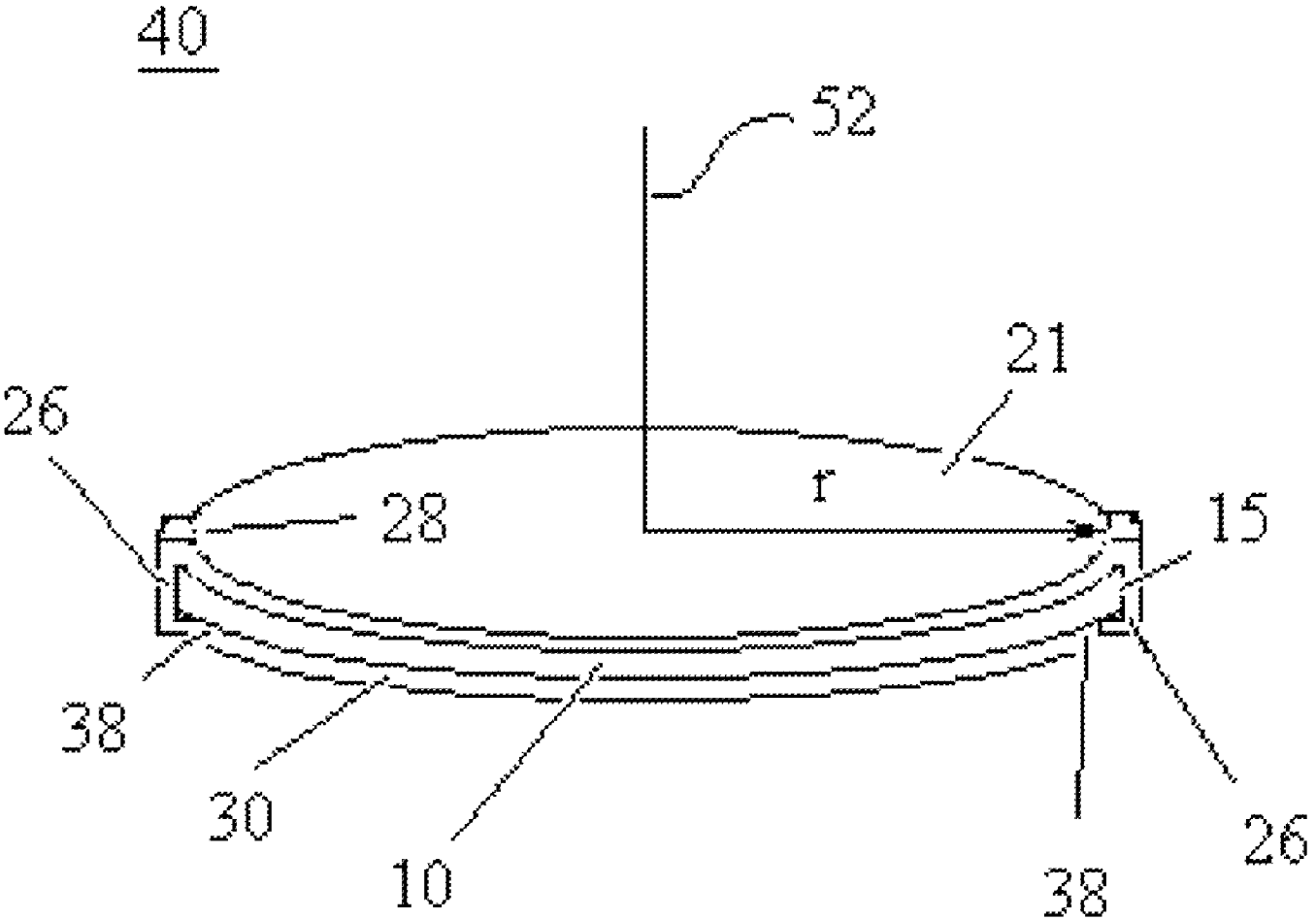
FIG. 5 is a depiction of a perspective top/side view of a chemical mechanical polishing pad manufacturing assembly for use with a method of the present invention.

The term "substantially circular cross section" as used herein and in the appended claims in reference to a chemical mechanical polishing pad or a polishing pad component (e.g., polishing layer, subpad layer, sacrificial layer, polishing pad stack) means that the longest radius, r, of a cross section from a central axis to an outer periphery of the polishing pad or polishing pad component is $\leqq 20\%$ longer than the shortest radius, r, of the cross section from the central axis to the outer periphery. (See FIG. 5).

Several exemplary embodiments of the method for manufacturing a multilayer chemical mechanical polishing pad of the present invention are described herein. Combinations comprising one or more of the exemplary embodiments described herein are specifically contemplated and given the teachings provided herein would be apparent to one of ordinary skill in the art.

In some embodiments, the method of the present invention comprises: providing a polishing layer; providing a subpad layer; providing an unset reactive hot melt adhesive; applying the unset reactive hot melt adhesive to the subpad layer, wherein the unset reactive hot melt adhesive is applied in a pattern of parallel lines; placing the polishing layer over the pattern of parallel lines of unset reactive hot melt adhesive forming a polishing pad stack; applying a force to the polishing pad stack pressing the polishing layer and subpad layer together; and, allowing the unset reactive hot melt adhesive to set forming a reactive hot melt adhesive bond between the polishing layer and the subpad layer forming a multilayer chemical mechanical polishing pad. In some aspects of these embodiments, the method further comprises: providing the subpad layer with at least two wrap around tabs; providing a backing plate having a top side and a bottom side; placing the subpad layer onto the backing plate with the bottom surface of the subpad layer facing the top side of the backing plate and folding the at least two wrap around tabs around to the bottom side of the backing plate and securing the at least two wrap around tabs to the bottom side of the backing plate before applying the unset reactive hot melt adhesive; and, removing the at least two wrap around tabs from the subpad layer and separating the polishing pad stack from the backing plate after the formation of the reactive hot melt adhesive bond between the polishing layer and the subpad layer.

In some embodiments, the method of the present invention comprises securing the wrap around tabs to the backing plate using any known method. In some aspects of these embodiments, the method comprises securing the wrap around tabs to the backing plate using at least one of tape, staples, adhesive, hook and loop fasteners (e.g., Velcro®), buttons, hooks and form fitting of the wrap around tab into a recessed area of a sacrificial layer secured to the bottom side of the backing plate.

In some embodiments, the method of the present invention comprises applying the unset reactive hot melt adhesive to the top surface of the subpad layer in a pattern of parallel lines. In some aspects of these embodiments, the method comprises applying the unset reactive hot melt adhesive in a pattern comprising ≧10 lines; preferably ≧20 lines; more preferably ≧40 lines; still more preferably ≧60 lines of unset reactive hot melt adhesive. In some aspects of these embodiments, the method comprises applying the unset reactive hot melt adhesive at a coat weight of 6,500 to 14,000 g/cm$^2$, preferably 8,350 to 12,100 g/cm$^2$. In some aspects of these embodiments, the method comprises applying a pattern of parallel lines, wherein the individual lines in the pattern are applied with a thickness of 0.05 to 0.20 mm, preferably 0.0762 to 0.172 mm. In some aspects of these embodiments, the method comprises applying a pattern of parallel lines, wherein the individual lines in the pattern are applied with a width of 1.5 to 3.25 mm, preferably 1.58 to 3.18 mm. In some aspects of these embodiments, the method comprises applying a pattern of parallel lines, wherein the individual lines in the pattern are applied with a spacing between adjacent lines of 1.5 to 3.25 mm, preferably 1.58 to 3.18 mm. In some aspects of these embodiments, the method comprises applying a pattern of parallel lines, wherein the individual lines in the pattern are applied with a thickness of 0.05 to 0.20 mm, preferably 0.0762 to 0.172 mm; a width of 1.5 to 3.25 mm, preferably 1.58 to 3.18 mm; and with a spacing between adjacent lines of 1.5 to 3.25 mm, preferably 1.58 to 3.18 mm. In some aspects of these embodiments, the method comprises applying a pattern of parallel lines, wherein the pattern of parallel lines has valleys disposed between the parallel lines. In some aspects of these embodiments, the method comprises applying a pattern of parallel lines, wherein the unset reactive hot melt adhesive applied in the valleys between the parallel lines has a thickness at the center of the individual valleys of ≦5% of the thickness of the unset reactive hot melt adhesive applied at the center of the individual lines. In some aspects of these embodiments, the method comprises applying an unset reactive hot melt adhesive that exhibits a melting temperature of 50 to 150° C., preferably of 115 to 135° C. and a pot life of ≦90 minutes after melting. In some aspects of these embodiments, the method comprises applying an unset reactive hot melt adhesive comprising a polyurethane resin (e.g., MorMelt™ R5003 available from Rohm and Haas Company).

In some embodiments, the method of the present invention comprises forming at least one reactive hot melt adhesive bond. In some aspects of these embodiments, the method comprises forming at least one reactive hot melt adhesive bond, wherein the thickness of the set reactive hot melt adhesive forming the at least one bond is uniform across the at least one bond. In some aspects of these embodiments, the thickness of the set reactive hot melt adhesive varies by ≦1%, preferably by ≦0.5% across the at least one bond. In some aspects of these embodiments, the method comprises forming at least one full coverage reactive hot melt adhesive bond, wherein the thickness of the set reactive hot melt adhesive forming the at least one full coverage bond varies by ≦1%, preferably by ≦0.5% across the at least one bond and wherein the at least one full coverage bond makes adhesive contact with ≧95%, preferably ≧98%, more preferably ≧99% of the facing surfaces of the adjacent polishing pad layers bonded therewith. In some aspects of these embodiments, the method comprises forming a reactive hot melt adhesive bond or bonds between certain layers of the multilayer chemical mechanical polishing pad, wherein the reactive hot melt adhesive bond or bonds exhibit a T-peel strength≧111 N at 305 mm/min as determined by ASTM 1876-01. In some aspects of these embodiments, method comprises forming a reactive hot melt adhesive bond or bonds having a T-peel strength of 111 N to 180 N at 305 mm/min as determined by ASTM 1876-01. In some aspects of these embodiments, the method comprises forming a reactive hot melt adhesive bond or bonds having a T-peel strength that exceeds the tear strength of at least one of the bonded layers.

In some embodiments, the method of the present invention further comprises: providing two nip rollers; and passing the polishing pad stack between the two nip rollers to remove air bubbles from between the layers to be bound by the reactive hot melt adhesive bond.

In some embodiments, the method of the present invention further comprises: providing a sacrificial layer having at least two recessed areas designed to facilitate securing of the subpad layer to the backing plate; and disposing the sacrificial layer on the bottom side of the backing plate.

In some embodiments, the method of the present invention further comprises: providing a sacrificial layer having at least two recessed areas designed to engage the at least two wrap around tabs; disposing the sacrificial layer on the bottom side of the backing plate; and engaging the at least two wrap around tabs with the at least two recessed areas. In some aspects of these embodiments, the at least two wrap around tabs do not make physical contact with the sacrificial layer.

In some embodiments, the method of the present invention further comprises: providing a sacrificial layer having at least two recessed areas designed to make an interlocking engagement with the at least two wrap around tabs; disposing the sacrificial layer on the bottom side of the backing plate; and interlocking the at least two wrap around tabs with the at least two recessed areas.

In some embodiments, the method of the present invention further comprises: providing a sacrificial layer having at least two recessed areas designed to engage the at least two wrap around tabs; providing a pressure sensitive adhesive; disposing the sacrificial layer on the bottom side of the backing plate with the pressure sensitive adhesive interposed between the sacrificial layer and the bottom side of the backing plate; and engaging the at least two wrap around tabs with the at least two recessed areas, wherein the pressure sensitive adhesive secures the sacrificial layer to the backing plate. In some aspects of these embodiments, the at least two wrap around tabs do not make physical contact with the sacrificial layer. In some aspects of these embodiments, the at least two wrap around tabs are designed to interlock with the at least two recessed areas and the step of engaging the at least two wrap around tabs with the at least two recessed areas comprises interlocking the at least two recessed areas with the at least two wrap around tabs.

In some embodiments, the method of the present invention further comprises: providing the subpad layer with perforations to facilitate the removal of the at least two wrap around tabs.

In some embodiments, the method of the present invention further comprises: providing a pressure sensitive adhesive interposed between the at least two wrap around tabs and the bottom side of the backing plate, wherein the pressure sensitive adhesive secures the at least two wrap around tabs to the backing plate.

In some embodiments, the method of the present invention further comprises: providing a pressure sensitive adhesive applied to the bottom surface of the subpad layer; providing a release liner, wherein the pressure sensitive adhesive is interposed between the release liner and the bottom surface of the subpad layer and wherein the release liner is interposed between the pressure sensitive adhesive and the top side of the backing plate.

In some embodiments, the method of the present invention further comprises: providing a pressure sensitive adhesive applied to the bottom surface of the subpad layer; providing a release liner, wherein the pressure sensitive adhesive is interposed between the bottom surface of the subpad layer and the release liner and wherein the release liner is interposed between the pressure sensitive adhesive and the top side of the backing plate, and wherein the release liner is absent from the at least two wrap around tabs such that the pressure sensitive adhesive applied to the at least two wrap around tabs secures the at least two wrap around tabs to the bottom side of the baking plate.

In some embodiments, the method of the present invention comprises: providing a polishing layer; providing a subpad layer having a top surface, a bottom surface and at least two perforated wrap around tabs; providing a backing plate having a top side and a bottom side; providing a sacrificial layer having at least two recessed areas designed to facilitate attachment of the subpad layer to the backing plate; providing an unset reactive hot melt adhesive; providing a first pressure sensitive adhesive; providing a second pressure sensitive adhesive; providing a release liner; applying the first pressure sensitive adhesive to the bottom surface of the subpad layer; placing the release liner over the first pressure sensitive adhesive, wherein the first pressure sensitive adhesive is disposed between the release liner and the bottom surface of the subpad layer; applying the second pressure sensitive adhesive to the sacrificial layer; placing the sacrificial layer on the bottom side of the backing plate with the second pressure sensitive adhesive interposed between the sacrificial layer and the bottom side of the backing plate, wherein the second pressure sensitive adhesive secures the sacrificial layer to the bottom side of the backing plate; removing the release liner from the at least two wrap around tabs exposing the first pressure sensitive adhesive applied thereto; placing the subpad layer onto the backing plate with the bottom surface of the subpad layer facing the top side of the backing plate; folding the at least two wrap around tabs around to the bottom side of the backing plate and securing the at least two wrap around tabs to the bottom side of the backing plate using the first pressure sensitive adhesive; applying an unset reactive hot melt adhesive to the top surface of the subpad layer, wherein the unset reactive hot melt adhesive is applied in a pattern of parallel lines, preferable ≧10 parallel lines, more preferably ≧20 parallel lines; still more preferably ≧40 parallel lines; yet more preferably 10 to 200 parallel lines; placing the polishing layer over the pattern of parallel lines of the unset reactive hot melt adhesive; pressing the polishing layer and subpad layer together and setting the unset reactive hot melt adhesive forming a reactive hot melt adhesive bond between the polishing layer and the subpad layer, wherein the T-peel strength of the reactive hot melt adhesive bond is ≧111 N at 305 mm/min, preferably 111 N to 180 N at 305 mm/min as determined according to ASTM 1876-01; and, removing the at least two wrap around tabs from the subpad layer and separating the subpad layer from the backing plate. In some aspects of these embodiments, the T-peel strength of the reactive hot melt adhesive bond formed exceeds the tear strength of at least one of the layers bonded by the reactive hot melt adhesive bond. In some aspects of these embodiments, the layers of the multilayer chemical mechanical polishing pad bonded by a reactive hot melt adhesive bond include the subpad layer and the polishing layer.

In some embodiments, the method of the present invention comprises: providing a polishing layer; providing a subpad layer having a top surface, a bottom surface and at least two wrap around tabs; providing an intervening layer having a top face and a bottom face; providing a backing plate having a top side and a bottom side; providing a first unset reactive hot melt adhesive; providing a second unset reactive hot melt adhesive; placing the subpad layer onto the backing plate with the bottom surface of the subpad layer facing the top side of the backing plate; folding the at least two wrap around tabs around to the bottom side of the backing plate and securing the at least two wrap around tabs to the bottom side of the backing plate; applying the first unset reactive hot melt adhesive to the top surface of the subpad layer, wherein the first unset reactive hot melt adhesive is applied in a first pattern of parallel lines; placing the intervening layer over the first pattern of parallel lines with the bottom face facing the first pattern of parallel lines; applying the second unset reactive hot melt adhesive to the top face of the intervening layer, wherein the second unset reactive hot melt adhesive is applied in a second pattern of parallel lines; placing the polishing layer over the second pattern of parallel lines forming a polishing pad stack; applying a force to the polishing pad stack pressing the polishing layer and subpad layer toward one another; allowing the first unset reactive hot melt adhesive and the second unset reactive hot melt adhesive to set forming a first reactive hot melt adhesive bond between the subpad layer and the intervening layer and a second reactive hot melt adhesive bond between the intervening layer and the polishing layer; and, removing the at least two wrap around tabs from the subpad layer and separating the subpad layer from the backing plate. In some aspects of these embodiments, the unset reactive hot melt adhesive selected for use as the first unset reactive hot melt adhesive is compositionally the same as or different from the unset reactive hot melt adhesive selected for use as the second unset reactive hot melt adhesive. In some aspects of these embodiments, the first unset reactive hot melt adhesive is applied in a pattern of parallel lines that is the same as or different from the pattern of parallel lines in which the second unset reactive hot melt adhesive is applied. One of ordinary skill in the art will understand that the different reactive hot melt adhesive bonds can be formed simultaneously as described above or in series (e.g., forming the first reactive hot melt adhesive bond, applying the second unset reactive hot melt adhesive, placing the polishing layer/intervening layer over the second unset reactive hot melt adhesive, applying a force, allowing second unset reactive hot melt adhesive to set forming second reactive hot melt adhesive bond). In some aspects of these embodiments, the method further comprises providing at least one additional intervening layer disposed between the subpad layer and the polishing layer in the polishing pad stack and bonding the at least one additional intervening layer to the subpad layer, the polishing layer, the intervening layer or another additional intervening layer in the polishing pad stack. In some aspects of these embodiments, the at least one additional intervening layer is bonded in the polishing pad stack using at least one of a pressure sensitive adhesive bond, a reactive hot melt adhesive bond and a contact adhesive bond.

In some embodiments, the method of the present invention further comprises: providing at least one opening in the polishing pad stack to facilitate the manufacture of a multilayer chemical mechanical polishing pad having a window to enable in situ monitoring of a chemical mechanical polishing operation. In some aspects of these embodiments, the method comprises providing at least one opening having a cross section selected from a circular cross section, an elliptical cross section and a squoval cross section. In some aspects of these embodiments, the method comprises providing at least one opening having a circular cross section. In some aspects of these embodiments, the method comprises providing at least one opening having an elliptical cross section. In some aspects of these embodiments, the method comprises providing at least one opening having a squoval cross section. In some aspects of these embodiments, the method comprises providing the subpad layer, the polishing layer and any intervening layers, wherein each such layer exhibits at least one opening to facilitate the incorporation of a window before such layers are incorporated into a polishing pad stack. In some aspects of these embodiments, the method comprises providing at least one layer selected from the subpad layer, the polishing pad layer and any intervening layers, wherein such at least one layer does not exhibit an opening (e.g., such layer can be transparent to the wavelength of light used for the in situ monitoring). In some aspects of these embodiments, the method of the present invention further comprises cutting, burning or otherwise forming at least one opening in the polishing pad stack to facilitate incorporation of a window after the individual layers have been combined to form a polishing pad stack.

In some embodiments, the method of the present invention further comprises incorporating a window block into the multilayer chemical mechanical polishing pad produced. In some aspects of these embodiments, the method further comprises inserting a window block into a hole in the polishing pad stack before applying a force to the polishing pad stack and allowing the unset reactive hot melt adhesive to set. In some aspects of these embodiments, the method further comprises: providing a window adhesive; inserting a window block into a hole in the polishing pad stack after the reactive hot melt adhesive bond or bonds are formed; and securing the window block in the hole with the window adhesive. In some aspects of these embodiment, the method comprises providing a window adhesive selected from a pressure sensitive adhesive, a contact adhesive and a reactive hot melt adhesive.

In some embodiments, the method of the present invention comprises providing a subpad layer selected from a material suitable for use in a chemical mechanical polishing pad. In some aspects of these embodiments, the method comprises providing a subpad layer comprising an elastic polymeric material. In some aspects of these embodiments, the method comprises providing a subpad layer comprising a material selected from a polyurethane impregnated felt and a polyurethane foam. In some aspects of these embodiments, the method comprises providing a subpad layer selected from a polyurethane impregnated felt. In some aspects of these embodiments, the method comprises providing a subpad layer selected from a polyurethane foam. In some aspects of these embodiments, the method comprises providing a subpad layer selected from a closed cell polyurethane foam. In some aspects of these embodiments, the method comprises providing a subpad layer selected from a buffed high density urethane foam.

In practicing the method of the present invention, one of ordinary skill in the art would understand to select a subpad layer having a thickness suitable to provide the desired mechanical properties to a given multilayer chemical mechanical polishing pad for use in a given polishing operation. In some aspects of these embodiments, the method of the present invention comprises providing a subpad layer having a thickness of 0.75 to 2.5 mm; preferably 0.75 to 2.0 mm.

In practicing the method of the present invention, one of ordinary skill in the art would understand to provide a backing plate having a suitable thickness and material of construction. In some embodiments, the method comprises providing a backing plate having a thickness of 2.54 to 5.1 mm. In some embodiments, the method of the present invention comprises providing a backing plate constructed of a material selected from aluminum and acrylic sheet.

In some embodiments, the method of the present invention comprises providing a polishing layer made from a polymeric material comprising a polymer selected from polycarbonates, polysulfones, nylons, polyethers, polyesters, polystyrenes, acrylic polymers, polymethyl methacrylates, polyvinylchlorides, polyvinylfluorides, polyethylenes, polypropylenes, polybutadienes, polyethylene imines, polyurethanes, polyether sulfones, polyamides, polyether imides, polyketones, epoxies, silicones, EPDM, and combinations thereof. In some aspects of these embodiments, the method comprises providing a polishing layer comprising a polyurethane.

In practicing the methods of the present invention, one of ordinary skill in the art would understand to select a polishing layer having a thickness suitable for use in a multilayer chemical mechanical polishing pad for a given polishing operation. In some embodiments, the method of the present invention comprises providing a polishing layer exhibiting an average thickness of 20 to 150 mils. In some aspects of these embodiments, the method comprises providing a polishing layer exhibiting an average thickness of 30 to 125 mils, more preferably 40 to 120 mils.

In some embodiments, the method of the present invention comprises providing at least one layer selected from the backing plate, the subpad layer, the polishing layer, the sacrificial layer and any intervening layer, wherein the at least one layer exhibits a substantially circular cross section. In some aspects of these embodiments, the method further comprises: cutting, die stamping, machining, the polishing pad stack to provide a multilayer chemical mechanical polishing pad exhibiting a substantially circular cross section. In some aspects of these embodiments, the method comprises providing a multilayer chemical mechanical polishing pad exhibiting a substantially circular cross section exhibiting a diameter of 600 to 1,600 mm, preferably 600 to 1,200 mm.

One of ordinary skill in the art would understand that the various polishing pad layers can be oriented differently in the polishing pad stack. For example, in some embodiments, in the method of the present invention, the subpad layer having at least two wrap around tabs can be substituted with a polishing layer having at least two wrap around tabs secured to the backing plate and the polishing layer can be substituted with a subpad layer to form a polishing pad stack.

Some embodiments of the present invention will now be described in detail in the following Examples. The Examples involve the preparation of multilayer chemical mechanical polishing pads having a substantially circular cross section with a central axis 52 and a radius r. (see, e.g., FIG. 5). Notwithstanding, given the teachings provided herein, one of ordinary skill in the art will understand how to employ the method of the present invention to produce multilayer chemical mechanical polishing pads having other geometric cross sections such as, for example, polygonal, annular, oval and amorphous.

EXAMPLES

The multilayer chemical mechanical polishing pads described in the examples were manufactured using a Black Brothers 775 Hot Melt Spreader and a Black Brothers air-pod press. The Black Brothers 775 Hot Melt Spreader was outfitted with a three roll system—a top coating roll, a top doctor roll and a bottom roll, wherein the doctor roll was temperature controlled. The top doctor roll and the bottom roll were both chrome. The top coating roll had a silicone rubber coating. The rolls were 44" long and the top coating roll and the bottom roll had 7.5" diameters. Both aluminum and acrylic backing plates were used. The backing plates used were 0.125" thick. The reactive hot melt adhesive utilized in the Examples was Mor-Melt™ R-5003 (commercially available from Rohm and Haas).

The Black Brothers 775 Hot Melt Spreader 100 was turned on and heat was turned on to the doctor roll. As the temperature of the doctor roll increased, the temperature of the coating roll also increased given its proximity to the doctor roll. The system was allowed to run until the coating roll reached a temperature of 230° F. Unset reactive hot melt adhesive was then feed to the trough 140 formed between the top coating roll 130 and the top doctor roll 120. (see FIG. 6). The temperature of the doctor roll was adjusted to provide a coat weight of 7-15 g/ft$^2$. The gap between top coating roll and bottom roll was then adjusted to facilitate the transfer of a pattern of unset reactive hot melt having the desired adhesive line width to the subpad layer. As the gap between the coating rolls is increased from zero, the unset hot melt adhesive transferred to the subpad changes from a uniform unpatterned layer to a textured layer comprising a pattern of parallel lines of adhesive. Further increases in the gap result in thinner lines of adhesive with a larger spacing therebetween.

Figure 6:
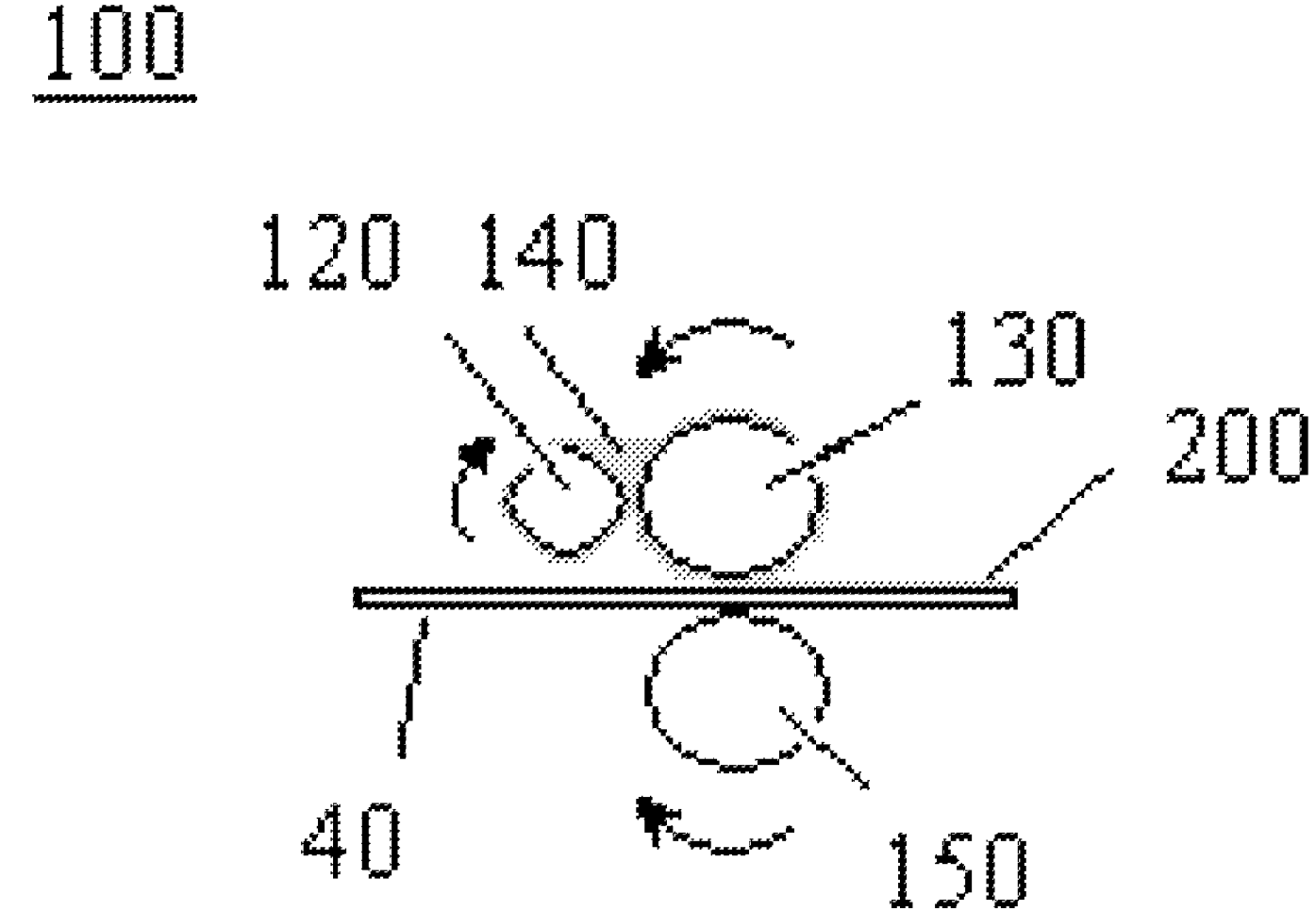
FIG. 6 is a depiction of an unset reactive hot melt adhesive spreading apparatus for use with a method of the present invention.
Figure 7A:
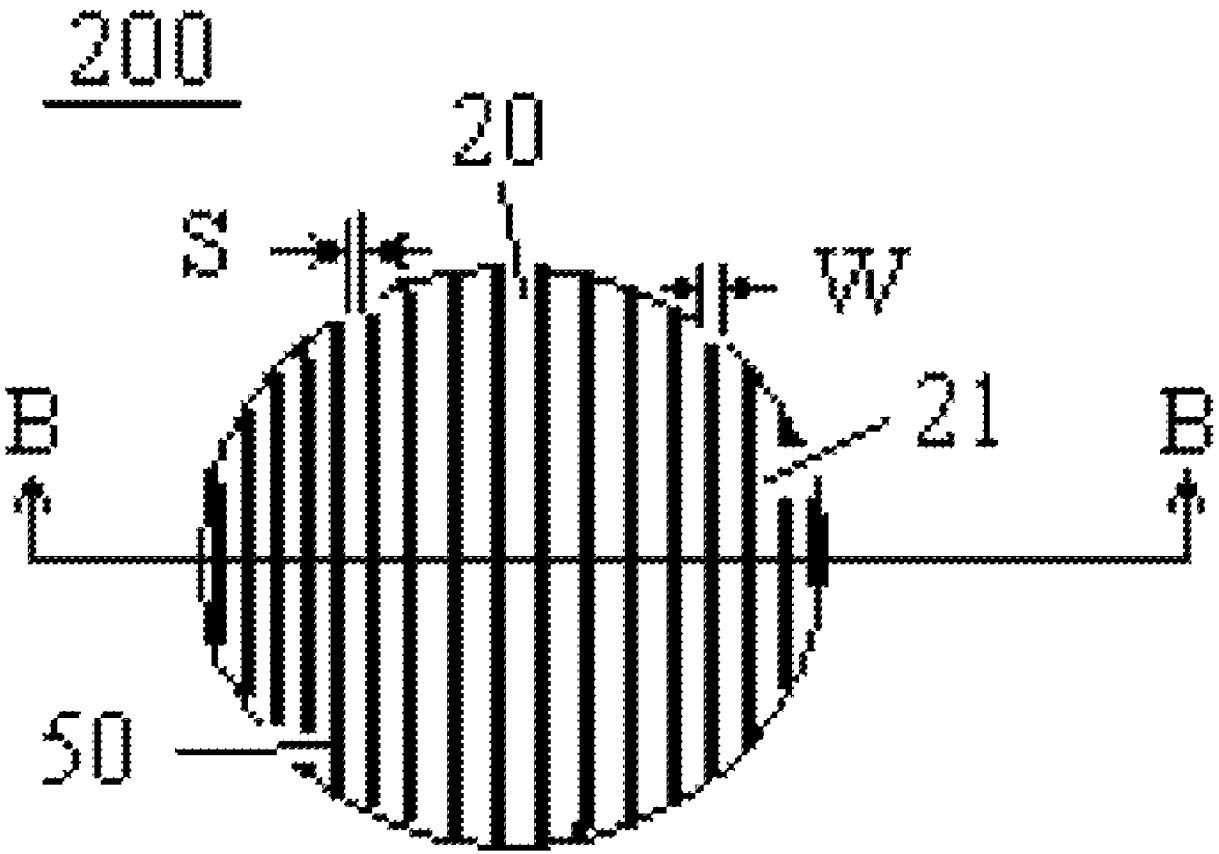
FIG. 7A is a depiction of a top plan view of a chemical mechanical polishing pad manufacturing assembly having an unset reactive hot melt adhesive applied to the top surface in a pattern of parallel lines.
Figure 7B:
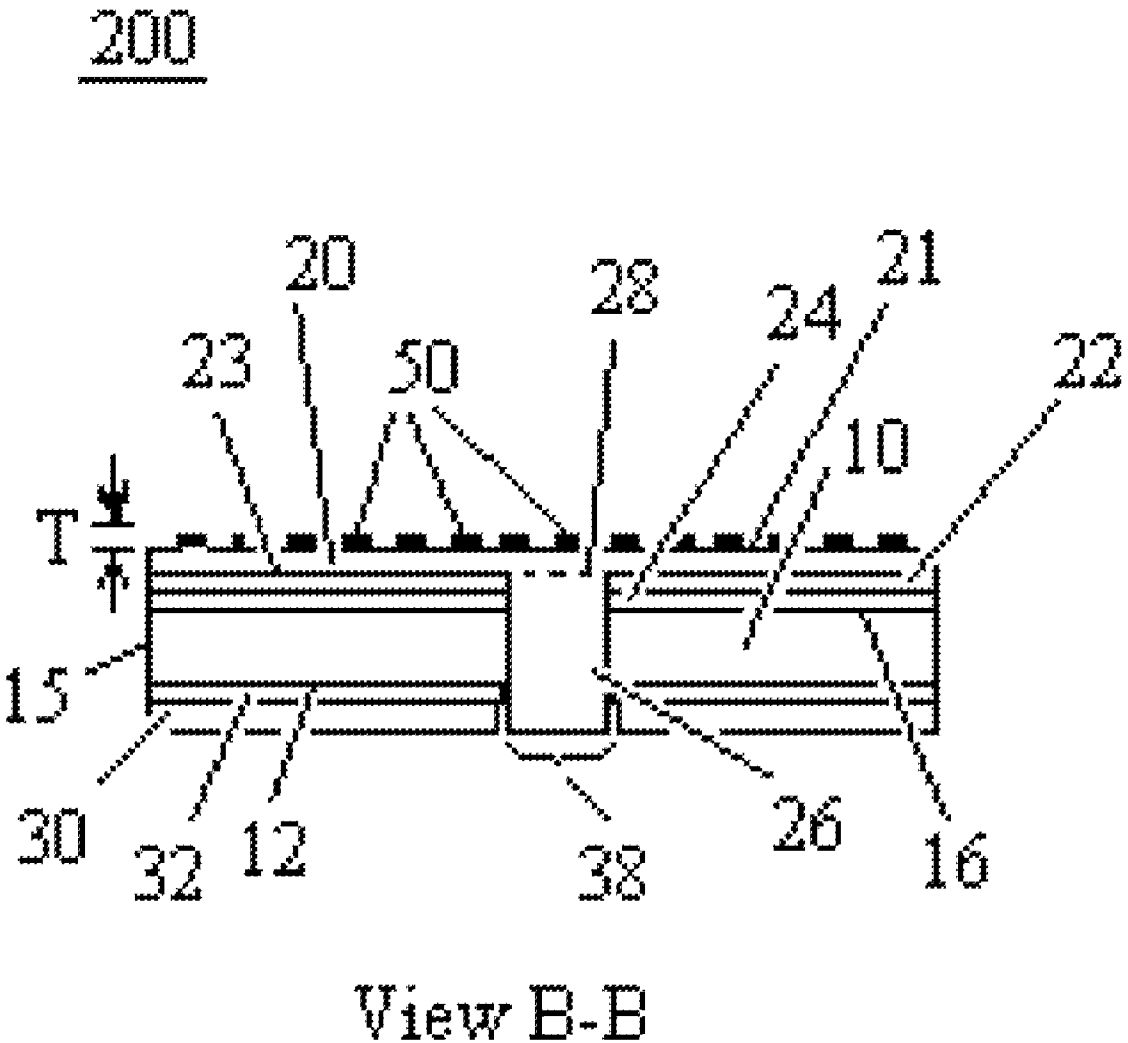
FIG. 7B is a depiction of a side elevational view of a cut away view B-B of the chemical mechanical polishing pad manufacturing assembly of FIG. 7A having an unset reactive hot melt adhesive applied to the top surface in a pattern of parallel lines.

A chemical mechanical polishing pad manufacturing assembly 40 (as depicted in FIGS. 4A-7B) was provided. In particular, a backing plate 10 (as depicted in FIGS. 1, 4B, 5 and 7A-7B) having a bottom side 12, a top side 16, and an outer periphery 15 was provided. As noted above, the backing plates used were aluminum or acrylic sheet and had a thickness of 0.125". A subpad layer 20 (as depicted in FIGS. 2, 4B, 5 and 7A-7B) was provided having a top surface 21, a bottom surface 23, two wrap around tabs 26; wherein the two wrap around tabs 26 had a perforation 28 to facilitate separation of the two wrap around tabs 26 from the subpad layer 20; wherein the wrap around tabs extended a distance D along a periphery 29 of the subpad layer and extended a length L from the perforation 28 and wherein the wrap around tabs were designed to fold around the outer periphery 15 of the backing plate 10 and to extend at least part way along the bottom side 12 of the backing plate 10. A first pressure sensitive adhesive 22 and a release liner 24 (as depicted in FIGS. 4B and 7A-7B) were provided. The first pressure sensitive adhesive 22 was applied to the bottom surface 23 of the subpad layer 20 and the release liner 24 was applied over the first pressure sensitive adhesive. A sacrificial layer 30 (as depicted in FIGS. 3-5 and 7A-7B) was provided having recessed areas 38 designed to engage with the two wrap around tabs 26. A second pressure sensitive adhesive 32 was provided. The second pressure sensitive adhesive 32 was applied to the sacrificial layer 30. The subpad layer 20 was placed onto the backing plate 10 with the bottom surface 23 of the subpad layer 20 facing the top side 16 of the backing plate 10. The release liner 24 was removed from the two wrap around tabs 26. The two wrap around tabs 26 were folded around the outer periphery 15 of the backing plate 10 to the bottom side 12 of the backing plate 10 and secured in place by the first pressure sensitive adhesive. The sacrificial layer 30 was secured to the bottom side 12 of the backing plate 10 using the second pressure sensitive adhesive 32 such that the recessed areas 38 engaged the wrap around tabs 26 forming the chemical mechanical polishing pad manufacturing assembly 40.

The chemical mechanical polishing pad manufacturing assembly 40 was fed through the Black Brothers 775 Hot Melt Spreader 100 (set up as described above) at a coater speed of 18 ft/min to transfer unset reactive hot melt adhesive to the top surface of the subpad layer of the assembly 40 to form an assembly 40 with an unset reactive hot melt adhesive applied thereto 200 in a pattern of parallel lines 50 (as depicted in FIGS. 7A-7B). The unset reactive hot melt adhesive spreading apparatus 100 comprised a doctor roll 120, a coating roll 130, and a bottom roll 150. The bottom roll 150 supported and fed the chemical mechanical polishing pad manufacturing assembly 40 through the spreading apparatus 100 (as depicted in FIG. 6). The doctor roll 120 and the coating roll 130 formed a trough for unset reactive hot melt adhesive 140. The unset reactive hot melt adhesive coated the coating roll 130, which transferred the unset reactive hot melt adhesive to the chemical mechanical polishing pad manufacturing assembly 40 forming a chemical mechanical polishing pad manufacturing assembly with an unset reactive hot melt adhesive applied thereto 200. Specifically, the chemical mechanical polishing pad manufacturing assembly 40 was oriented such that the subpad layer 20 was facing up in the direction of the coating roll 130 and such that a wrap around tab 26 side of the assembly 40 was the first part of the assembly 40 fed between the coating roll 130 and the bottom roll 150 to provide the chemical mechanical polishing pad manufacturing assembly with an unset reactive hot melt adhesive applied thereto 200.

FIG. 7A provides a depiction of a top plan view of the chemical mechanical polishing pad manufacturing assembly with the unset reactive hot melt adhesive applied thereto 200 in a pattern of parallel lines 50. Specifically, FIG. 7A depicts the subpad layer 20 having top surface 21 with the unset reactive hot melt adhesive applied thereto in pattern of parallel lines 50, wherein the individual lines exhibited a width W and a separation S between adjacent lines. FIG. 7B provides a depiction of a side elevational view B-B of the chemical mechanical polishing pad manufacturing assembly of FIG. 7A. Specifically, FIG. 7B depicts subpad layer 20 having top surface 21 with the unset reactive hot melt adhesive applied in a pattern of parallel lines 50 having thickness T. The lines on the pattern of parallel lines formed were 3-5 mils thick, 1/16 to 1/8" wide, and were spaced 1/16 to 1/8" apart.

A polishing layer was then placed over the pattern of parallel lines on the top surface of the subpad layer to form a stack. The stack was then placed in a press and pressed for 1 minute at 20 psi. The pressed stack was then removed from the press and the stack was removed from the backing plate by separating the two wrap around tabs from the subpad layer to provide a multilayer chemical mechanical polishing pad.

Comparative Example

The same process as described in Example 1 was used, except the unset reactive hot melt adhesive was transferred at the same coat weight to the top surface of the subpad layer in an untextured flat layer (i.e., not in a pattern of parallel lines).

Testing

Figure 8:
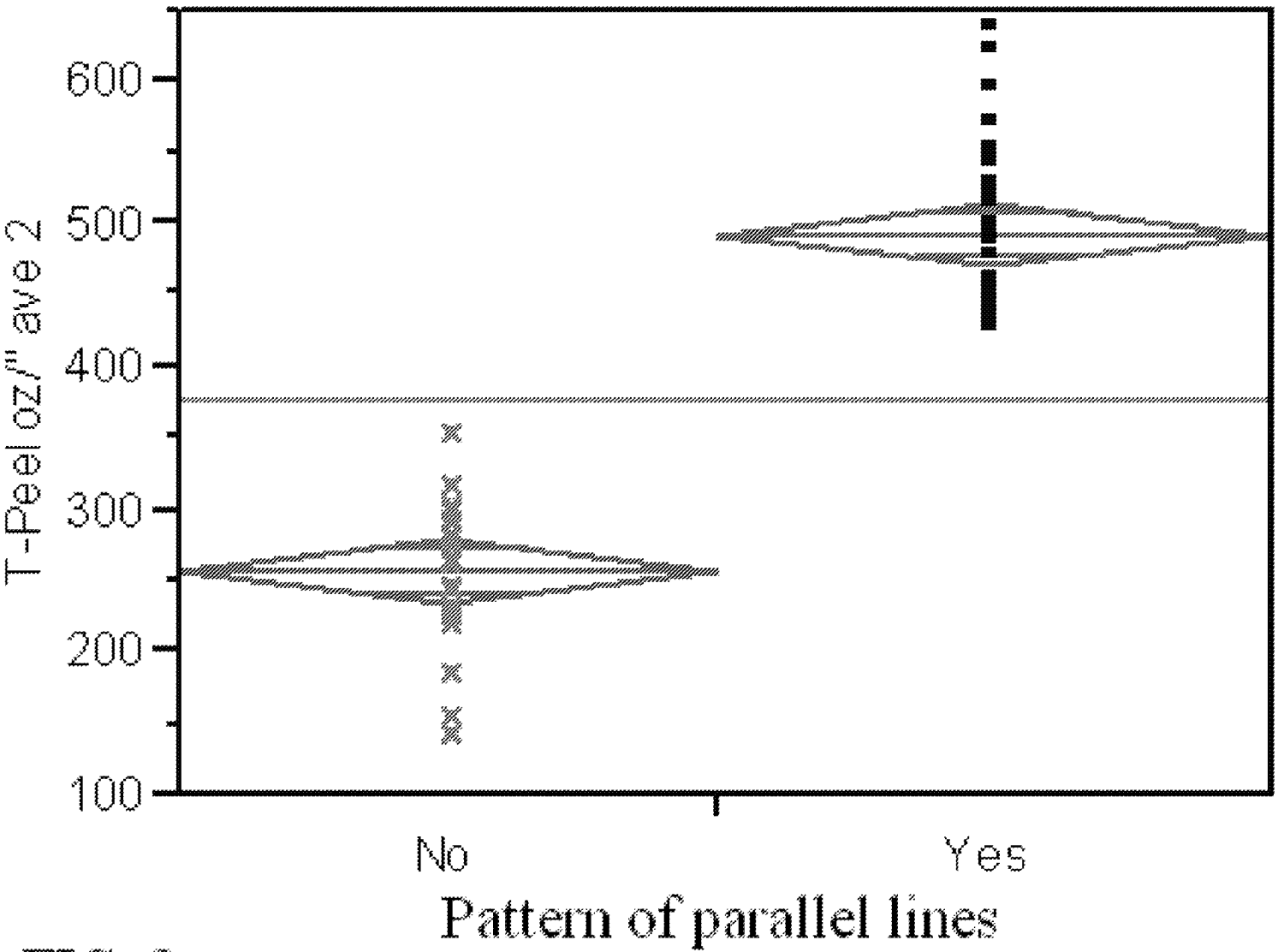
FIG. 8 is a graph depicting the test results for Example 1 and the Comparative Example.

The multilayer chemical mechanical polishing pads prepared according to Example 1 and the Comparative Example were analyzed to determine the one way T-peel strength of the reactive hot melt adhesive bond formed between the subpad layer and the polishing layer. T-peel data were obtained according to the ASTM Standard Test Method for Peel Resistance of Adhesives (ASTM D1876-01) using an MTS Systems Model Number QTEST/1L tester. Note that the samples were conditioned for 24 hrs before testing (the 7 day aging period is unnecessary for the subject adhesive). The multilayer chemical mechanical polishing pads prepared according to Example 1 with a pattern of parallel lines of unset reactive hot melt adhesive resulted in substrate tear or split, which is the preferred failure mode. The T-peel strength for clean separation was ≧111 Newtons at 305 mm/min for samples of the multilayer chemical mechanical polishing pads prepared using a pattern of parallel lines of unset reactive hot melt adhesive and was 41 to 100 Newtons at 305 mm/min for samples of the multilayer chemical mechanical polishing pads prepared using an untextured layer of unset reactive hot melt adhesive. (see FIG. 8).

We claim:

1. A method for manufacturing a multilayer chemical mechanical polishing pad comprising:

providing a polishing layer;

providing a subpad layer having a top surface and a bottom surface;

providing an unset reactive hot melt adhesive;

providing the subpad layer with at least two wrap around tabs;

providing a backing plate having a top side and a bottom side;

placing the subpad layer onto the backing plate with the bottom surface of the subpad layer facing the top side of the backing plate and folding the at least two wrap around tabs around to the bottom side of the backing plate and securing the at least two wrap around tabs to the bottom side of the backing plate before applying the unset reactive hot melt adhesive;

applying the unset reactive hot melt adhesive to the top surface of the subpad layer, wherein the unset reactive hot melt adhesive is applied in a pattern of parallel lines;

placing the polishing layer over the pattern of parallel lines of unset reactive hot melt adhesive forming a polishing pad stack;

applying a force to the polishing pad stack pressing the polishing layer and subpad layer together;

allowing the unset reactive hot melt adhesive to set forming a reactive hot melt adhesive bond between the polishing layer and the subpad layer; and, removing the at least two wrap around tabs from the subpad layer and separating the subpad layer from the backing plate after the formation of the reactive hot melt adhesive bond between the polishing layer and the subpad layer.

2. The method of claim 1, further comprising:

providing a sacrificial layer having at least two recessed areas designed to facilitate securing of the subpad layer to the backing plate;

disposing the sacrificial layer on the bottom side of the backing plate.

3. The method of claim 1, further comprising:

providing a sacrificial layer having at least two recessed areas designed to engage the at least two wrap around tabs; and, disposing the sacrificial layer on the bottom side of the backing plate; and engaging the at least two wrap around tabs with the at least two recessed areas.

4. The method of claim 1, further comprising:

providing a sacrificial layer having at least two recessed areas designed to engage the at least two wrap around tabs;

providing a pressure sensitive adhesive;

disposing the sacrificial layer on the bottom side of the backing plate with the pressure sensitive adhesive interposed between the sacrificial layer and the bottom side of the backing plate; and engaging the at least two wrap around tabs with the at least two recessed areas.

5. The method of claim 1, further comprising:

providing the subpad layer with perforations to facilitate removal of the at least two wrap around tabs.

6. The method of claim 1, further comprising:

providing a pressure sensitive adhesive interposed between the at least two wrap around tabs and the bottom side of the backing plate, wherein the pressure sensitive adhesive secures the at least two wrap around tabs to the backing plate.

7. The method of claim 1, further comprising:

providing a pressure sensitive adhesive applied to the bottom surface of the subpad layer;

providing a release liner, wherein the pressure sensitive adhesive is interposed between the release liner and the bottom surface of the subpad layer and wherein the release liner is interposed between the pressure sensitive adhesive and the top side of the backing plate.

8. The method of claim 1, further comprising:

providing a pressure sensitive adhesive applied to the bottom surface of the subpad layer;

providing a release liner, wherein the pressure sensitive adhesive is interposed between the bottom surface of the subpad layer and the release liner and wherein the release liner is interposed between the pressure sensitive adhesive and the top side of the backing plate, and wherein the release liner is absent from the at least two wrap around tabs such that the pressure sensitive adhesive applied to the at least two wrap around tabs secures the at least two wrap around tabs to the bottom side of the baking plate.

9. A method for manufacturing a multilayer chemical mechanical polishing pad comprising:

providing a polishing layer;

providing a subpad layer having a top surface, a bottom surface and at least two wrap around tabs;

providing an intervening layer having a top face and a bottom face;

providing a backing plate having a top side and a bottom side;

providing a first unset reactive hot melt adhesive;

providing a second unset reactive hot melt adhesive;

placing the subpad layer onto the backing plate with the bottom surface of the subpad layer facing the top side of the backing plate;

folding the at least two wrap around tabs around to the bottom side of the backing plate and securing the at least two wrap around tabs to the bottom side of the backing plate;

applying the first unset reactive hot melt adhesive to the top surface of the subpad layer, wherein the first unset reactive hot melt adhesive is applied in a first pattern of parallel lines;

placing the intervening layer over the first pattern of parallel lines with the bottom face facing the first pattern of parallel lines;

applying the second unset reactive hot melt adhesive to the top face of the intervening layer, wherein the second unset reactive hot melt adhesive is applied in a second pattern of parallel lines;

placing the polishing layer over the second pattern of parallel lines forming a polishing pad stack;

applying a force to the polishing pad stack pressing the polishing layer and subpad layer toward one another;

allowing the first unset reactive hot melt adhesive and the second unset reactive hot melt adhesive to set forming a first reactive hot melt adhesive bond between the subpad layer and the intervening layer and a second reactive hot melt adhesive bond between the intervening layer and the polishing layer; and, removing the at least two wrap around tabs from the subpad layer and separating the subpad layer from the backing plate.

* * * * *